US005842404A

United States Patent [19]

Triado Isern et al.

[11] Patent Number: 5,842,404

[45] Date of Patent: Dec. 1, 1998

[54] MECHANISM FOR SETTING THE TWO END POSITIONS OF A PISTON FOR A TURNING SHAFT OF THE RACK AND PINION TYPE

[75] Inventors: D. Joaquin Triado Isern; D. Fermin Cantenys Soler, both of Figueres, Spain

[73] Assignee: Talleres Quifer, S.L., Spain

[21] Appl. No.: 490,660

[22] Filed: Jun. 15, 1995

[30] Foreign Application Priority Data

Jun. 15, 1994 [ES] Spain ..... 9401661 U

[51] Int. Cl.[6] ..... F15B 31/24

[52] U.S. Cl. ..... 92/13.6

[58] Field of Search ..... 92/13.6

[56] References Cited

U.S. PATENT DOCUMENTS

| | | | |
|---|---|---|---|
| 1,888,392 | 11/1932 | Penick et al. | 92/13.6 |
| 3,156,160 | 11/1964 | Meyer et al. | 92/13.6 |
| 3,791,616 | 2/1974 | Le Rouax | 92/13.6 |
| 3,958,493 | 5/1976 | Fujita et al. | 92/13.6 |
| 4,949,936 | 8/1990 | Messina | 92/13.6 |

FOREIGN PATENT DOCUMENTS

| | | | |
|---|---|---|---|
| 2046164 | 3/1972 | Germany | 92/13.6 |

*Primary Examiner*—F. Daniel Lopez

*Attorney, Agent, or Firm*—Sixbey, Freidman, Leedom & Fergson, P.C.; Gerald J. Ferguson, Jr.; Tim L. Brackett, Jr.

[57] ABSTRACT

A mechanism for setting the two end positions of a piston for a turning shaft of the rack and pinion type, being equally applicable to driving gears which use slotted or other guides as a system of conversion of lineal into turning movement, the mechanism consisting of a piston which moves alternatively from inside a sleeve, with one of the ends closed by a cover. The movement of the piston in either direction is effected by means of a fluid, and this movement is what starts the action over the corresponding turning shaft, whose rotary transmission can be effected by means of a rack and pinion or other type of element.

1 Claim, 1 Drawing Sheet

Figure 1:
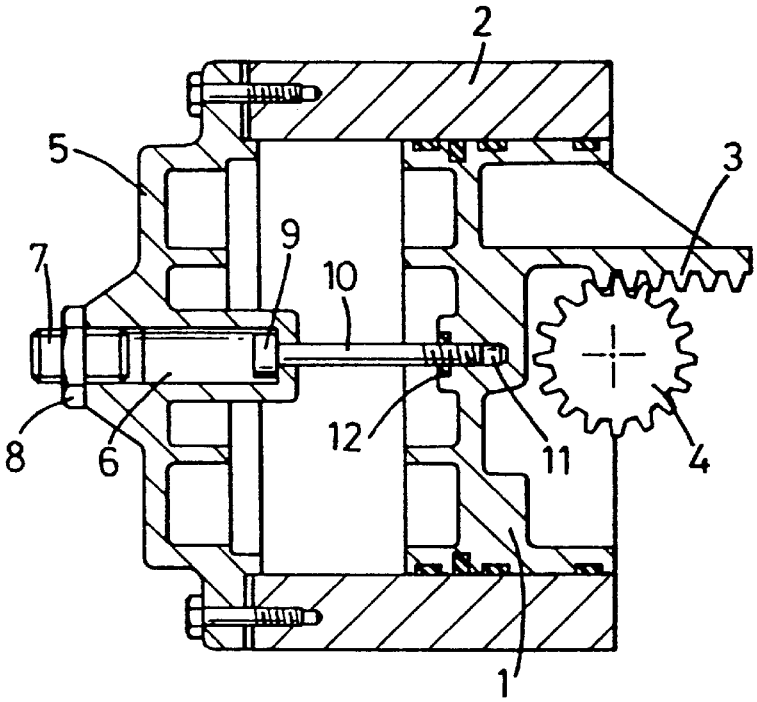
Figure 2:
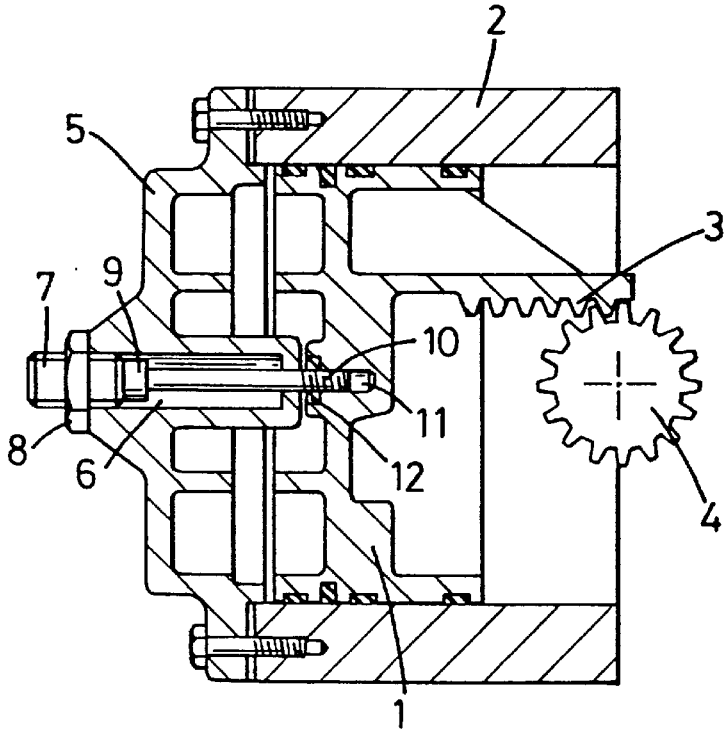

MECHANISM FOR SETTING THE TWO END POSITIONS OF A PISTON FOR A TURNING SHAFT OF THE RACK AND PINION TYPE

The invention refers to a mechanism for setting the two end positions of a piston for a turning shaft of the rack and pinion type, being equally applicable to driving gears which use slotted or other guides as a system of conversion of lineal into turning movement.

The structure to which the mechanism of the invention is applicable consists basically of a piston which moves alternately from inside a sleeve, with one of the ends closed by a cover. The movement of the piston in either direction is effected for means of a fluid, and this movement is what starts the action over the corresponding turning shaft, whose rotary transmission can be effected by means of a rack and pinion or other type of element.

In any case the piston requires a setting which delimits the two movements, one towards the inside and the other towards the outside.

This setting is usually effected in many cases by limiting only one of the two movements; that is, it only sets one of the two end positions of the run, carrying it into effect by means of a threaded screw in the sleeve cover, which crosses over so that it will be the inside end of the screw that limits the movement of the piston from its run towards the inside. The screw is fixed in its final position by means of a lock nut.

In certain cases the setting is effected in both directions of the run, so that in one direction it will be effected in the same way as described in the previous paragraph, while in the other direction it is effected by means of a second threaded screw on the piston itself, it being threaded through this so that the free end brakes against an element situated on the other part.

Well then, the said second setting causes a series of problems or difficulties such as the necessity or removing the cover in order to fit the screw which is threaded of the piston, so that this removal of the cover can occasion the entry of water, dirt, etc.

Beside, having to make the threaded screw on the piston brake against an element situated on the side opposite the cover alters the normal operation of the mechanisms which can be located in this area.

Likewise, the piston having a threaded hole for the fitting of the regulator screw referred to, can cause leakage of driving fluid, leakage which evidently could be produced through the threaded hole in which the said regulator screw is fitted.

The mechanism which is proposed has been conceived to resolve this problem to the best satisfaction, and as a solution that is both simple mad efficient, since the mechanism in question is conceived so that the setting can be effected in both directions of the run without the necessity of making any threaded hole in the piston.

More specifically, the mechanism of the invention relies on the cover of a threaded cavity that is affected which receives at its end the assembly by threading of the regulator screw which limits the displacement of the piston in one direction, while the rest of the cavity is designed to place the head of a second threaded screw on the piston, although in this case the threading of the said second screw is effected in the blind hole of the piston, the inside end of the first screw forming the brake for the head of the second screw in the movement in the other direction, thus bringing about a regulator mechanism from the two end positions of the piston, effecting the setting without the necessity for removing the cover and without the neccessity for a threaded hole in the piston.

The mechanism in its assembly is planned to form part of an impeller drive or to operate turning shafts, by means or a fluid under pressure. A concrete application is that of its use in the opening and closing of ball valves, plug valves and in general for any mechanism or appliance which requires a turn of 90° to 180°.

To complement the description which is going to be carried out immediately and with the object of helping towards a better understanding of the features of the invention, a detailed description will be made with regard to a set of drawings of a merely orientative and non-limiting nature in which the following have been represented:

In the first figure, a cross-section of the mechanism at an end position of movement of the piston is shown.

In the second figure, another cross-section of the same mechanism at the opposite end position of movement of the piston is shown.

In the aforementioned figures, the numerical references correspond to:

1. Piston.
2. Sleeve.
3. Rack.
4. Pinion
5. Cover.
6. Cavity.
7. Screw fitted in the cover (5).
8. Lock nut of the screw (7).
9. Head of the screw (10).
10. Head fitted on the piston (1).
11. Blind hole of the piston (1) in which the screw is fitted (10).
12. Pressed part locking the screw (10).

As may be seen in the figures referred to, the mechanism of the invention is applicable to any type of appliance which is comprised of a piston (1) that is movable axially inside a sleeve (2), the run being limited to two opposite ends.

The alternative movement of the said piston (1) is designed to turn a shaft, as a consequence of which such a piston (1) features an appearance consisting of a rack (3) which engages a pinion (4) belonging to or forming part of the said shaft.

The sleeve (2) is closed at one of its bases or ends by means of a cover (5), which is fixed with screws and is therefore removable.

The cover (5) has a cavity in the centre (6) which is placed transversally as if it were a threaded hole, since the inside bottom of such a cavity (6) is affected by a concentric hole, so that that forms a passage or threaded hole.

At the end of the external run of the said cavity (6) a screw (7) is threaded which can be fixed by means of an external lock nut (8), with the special feature that this screw (7) occupies only one run of such a cavity (6), leaving the rest free to allow the placing of the head (9) and part of a screw (10) threaded into a blind hole (11) intended for this purpose on the piston (1).

The axial shaft of the cavity (6) coincides with the axial shaft of the hole (11), so that the axial movements in either direction of the piston (1) accompany the movement in the corresponding direction of the head (9) of the screw (10) inside the cavity (6), the inside end of the screw (7) and the bottom of the cavity (6) forming the limiting stops of the run of the piston (1), since the screw (10) is locked on the piston (1) by means of a pressed part (12) of elastic material, the head (9) of which will strike or cause to brake against the said inside end of the screw (7) or the bottom of the cavity (6), according to the direction of movement of the piston (1).

The setting of the end position shown in the first figure, will be brought about by tightening or loosening of the screw (10), while the setting of the end position shown in the second figure, will be brought about by means of the screw (7).

To effect the said settings, first the lock nut (8) and the screw (7) must be removed, then the piston (1) placed in the position in the first figure, and by inserting a screwdriver into the cavity (6) in the cover (5) the said position set by tightening or loosening the screw (10). Secondly, the piston (1) is placed in the position in the second figure; then the head (9) of the screw (10) will move to the left within the cavity (6) in the cover; and thirdly, the screw (7) is inserted into the cavity, moving it forwards by means of its thread until it moves the screw (10) and the piston (1), since they belong to it. Then, in order to secure the screw (7), the lock nut (8) is placed in position and tightened.

To effect all the said operations for setting the two end positions of the piston (1), it is not necessary to remove the cover (5), which implies a considerable saving in maintenance, eliminating the possibility of foreign bodies and water getting inside the sleeve (2) where the piston (1) is housed, only two simple tools being needed for effecting all operations.

As it has been possible to prove, all the mechanisms of setting the two end positions are located in the area or side of the piston (1), the other area or side remaining free for other mechanisms.

It is evident that the mechanism described will be independent of the number of pistons with rack acting on the pinion, covering the possibility of including more than one piston with rack acting upon the same pinion.

We claim:

1. A piston cylinder actuator for turning a shaft comprising a piston movable in opposite directions in a cylinder, said piston having a rack which is connected to and rotates a pinion joined to said shaft, and a blind threaded hole to which a first screw is threadedly and adjustably attached;

said cylinder including an end closed by a cover, said cover including a cavity having a threaded portion at one end and a bottom portion with a through hole therethrough at an opposite end; a second screw adjustably threadedly attached to said threaded portion of said cavity;

said first screw extending through said through hole in said cover and having a head contained within said cavity, wherein a first end position of said piston is limited by said head of said first screw contacting said bottom of said cavity and a second end position of said piston is limited by said head of said first screw contacting a portion of said second screw, and wherein said first end position is adjustable by rotating said first screw relative to said threaded hole in said piston and said second end position is adjustable by rotating said second screw relative to said threaded portion of said cavity.

* * * * *